United States Patent [19]

Bibow

[11] Patent Number: 4,526,002

[45] Date of Patent: Jul. 2, 1985

[54] EXHAUST RELIEF SYSTEM

[75] Inventor: Lawrence C. Bibow, Fond du Lac, Wis.

[73] Assignee: Brunswick Corporation, Skokie, Ill.

[21] Appl. No.: 565,422

[22] Filed: Dec. 27, 1983

[51] Int. Cl.[3] ..... F01N 7/12

[52] U.S. Cl. ..... 60/293; 60/310; 60/320; 440/89

[58] Field of Search ..... 60/293, 310, 320; 440/89

[56] References Cited

U.S. PATENT DOCUMENTS 3,552,121 1/1971 Kitagawa ..... 440/89

3,921,398 11/1975 Kashmerick ..... 60/310

*Primary Examiner*—Douglas Hart

*Attorney, Agent, or Firm*—O. T. Sessions

[57] ABSTRACT

The engine (11) of a stern drive (10) is provided with a vacuum relief valve (28) to relieve any vacuum which may occur in the exhaust manifold (16), thus preventing water from entering the engine through the exhaust system. The relief valve (28) is connected to allow one-way flow from the intake manifold (15) to the exhaust system, thus providing an essentially closed system.

5 Claims, 3 Drawing Figures

EXHAUST RELIEF SYSTEM

DESCRIPTION

1. Technical Field

This invention relates to exhaust systems for marine engines and particularly to such engines arranged to discharge exhaust underwater.

2. Background Art

All internal combustion engines can develop low pressure in their exhaust systems under certain conditions. In a four-cycle engine the low pressure can result during the period of overlap of the intake and exhaust valve or from reverse rotation of the engine, for example. When such an engine is arranged to discharge its exhaust underwater, as typical with marine engines, the low pressure in the exhasut system can cause water to be forced into the engine, thereby seriously damaging the engine.

Prior marine engines such as those disclosed in U.S. Pat. Nos. 4,178,873 and 3,759,041 have used valves in the exhaust system to block the flow of water into the exhaust system. Though such valves have proven generally satisfactory in exhaust systems having cooling water injected into the exhaust stream upstream of the valve, they have been susceptible to damage if the engine is operated even briefly without cooling water. Without the cooling water, the exhaust can reach temperatures high enough to damage the valve.

DISCLOSURE OF INVENTION

The invention provides a vacuum relief means connected to the exhaust system of a four-cycle engine which discharges the engine exhaust underwater. The vacuum relief means acts to relieve any vacuum created in the exhaust system, thus preventing water from entering the engine through the exhaust system. The vacuum relief means may include a one-way valve to allow flow into the exhaust system to relieve any vacuum created therein.

Preferably, the vacuum relief means includes a passageway connecting the exhaust system to the intake manifold. The one-way valve is placed in the passage to allow flow from the intake manifold to the exhaust system when a vacuum arises in the exhaust system. This arrangement is particularly helpful should reverse rotation of the engine occur, causing a high pressure in the intake manifold and a low pressure in the exhaust system.

It is further preferable to connect the relief means to the exhaust system near the high point of the exhaust system, thus preventing water from entering and possibly interfacing with the operation of the vacuum relief means.

BEST MODES FOR CARRYING OUT THE INVENTION

Figures 1, 3:
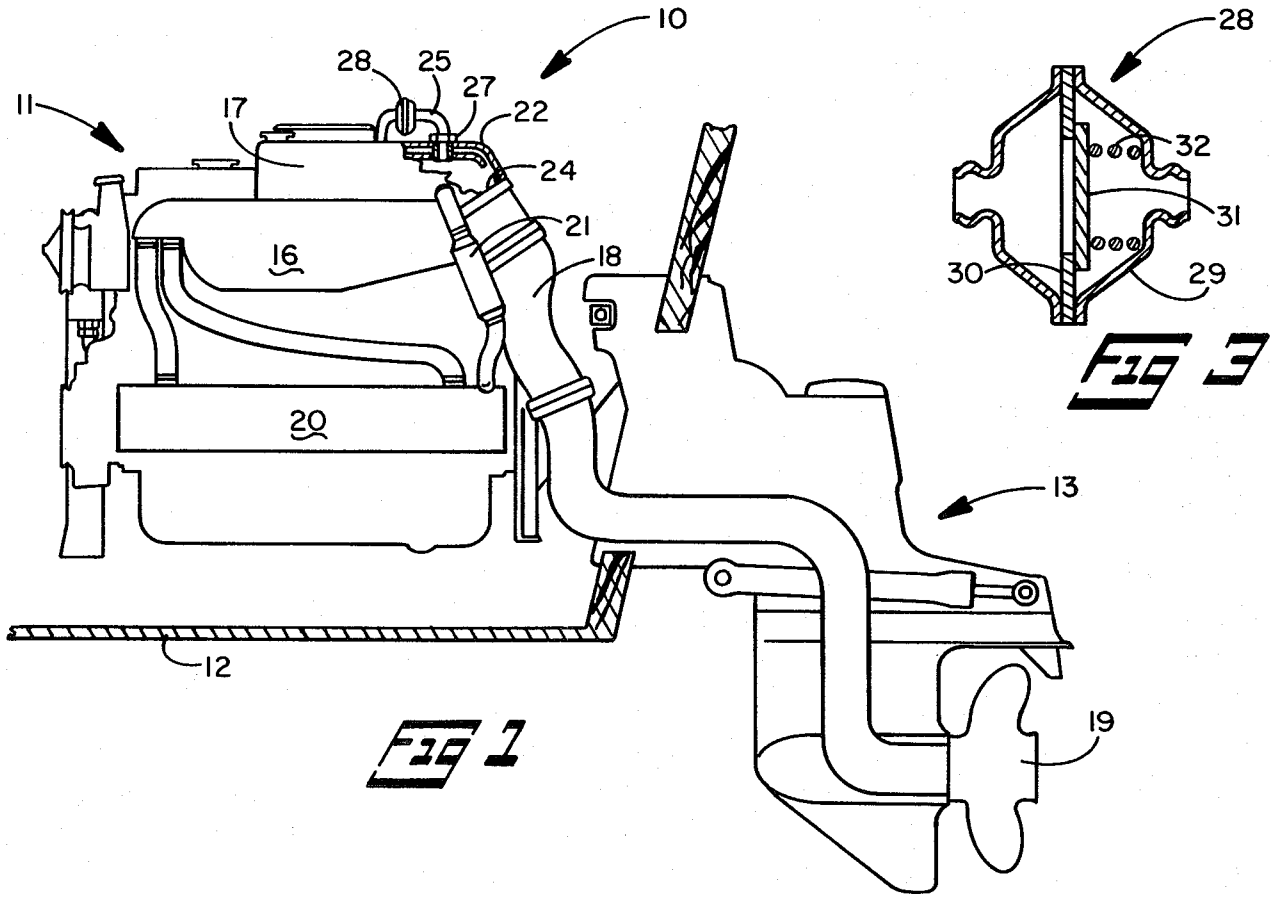
FIG. 1 is a side view partially in section showing a stern drive incorporating the present invention.
FIG. 3 is a cross-sectional view of a valve used in the device of FIGS. 1 and 2.
Figure 2:
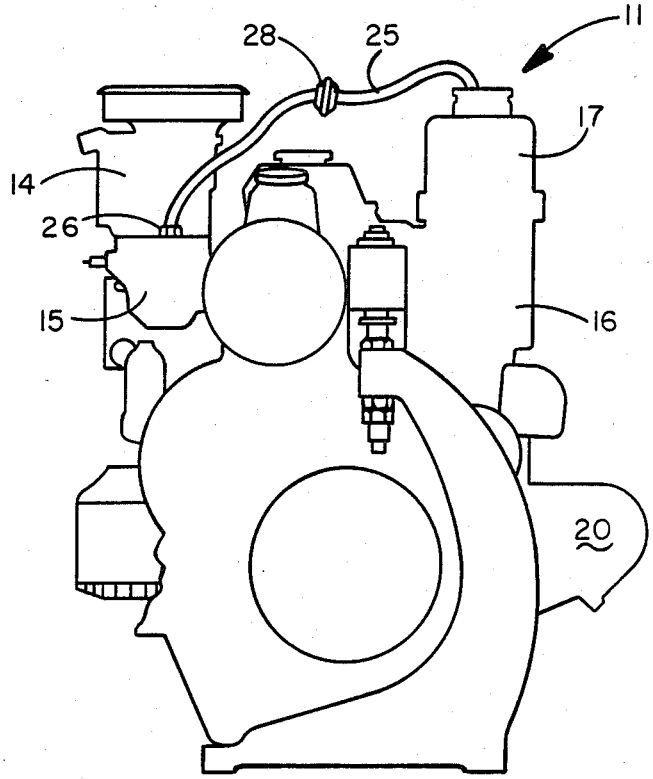
FIG. 2 is an end view of the engine used in the stern drive of FIG. 1.

Turning now to the drawings, a stern drive 10 is illustrated having an engine 11 mounted on the inside of a hull of a boat 12 and connected to drive an outboard propulsion unit 13 attached to the stern of the boat 12.

The engine 11 is a four-cycle engine which draws in air-fuel mixture from a carburetor 14 through an intake manifold 15 and into the engine 11 where it is burned in the cylinders to drive the engine 11. From the cylinders the exhaust gases are discharged into an exhaust manifold 16. From the exhaust manifold 16 the exhaust exits through an exhaust elbow 17 and passes downwardly into the outboard propulsion unit 13. An exhaust passageway 18 is formed through the outboard propulsion unit 13 and discharges through the propeller 19 or other underwater opening, in a well known manner.

The engine illustrated is cooled by fresh water taken in through the outboard propulsion unit 13 and circulated through a heat exchanger 20, though the engine could be directly cooled by the fresh water. From the heat exchanger 20 the fresh water is conducted through a passage 21 to the cooling jacket 22 of an exhaust elbow 17. The cooling water exits the cooling jacket 22 through an opening 24 into the exhaust passageway 18 and is mixed with the exhaust from the engine 11. The fresh water in the heat exchanger 20 is used to cool the engine coolant which is circulated through the engine block and exhaust manifold 16.

To prevent the inadvertent entrance of water into the engine through the exhaust system a connection is made between the intake manifold 15 and the exhaust system. The inlet to the connecting passage 25 is provided by a fitting 26 provided on the intake manifold 15. The outlet of the passage 25 is a fitting 27 on the exhaust elbow 17. The fitting on the exhaust elbow 17 passes through the water jacket 22 to the main exhaust passage 18. A one-way valve 28 connected between the fittings 26 and 27 by hoses prevents flow from the exhaust elbow 17 to the inlet manifold 15.

The body of the valve 29 includes a valve seat 30 formed internally. A valve member 31 is against signal the valve seat 30 by a spring 32. The spring 32 is sized allow the valve to open before sufficient suction occurs in the exhaust manifold 16 to draw water up the exhaust passageway 18 and into the engine 11.

OPERATION

In normal operation of a stern drive 10 equipped according to the invention, the exhaust system will have a higher pressure than the inlet manifold 15 during all conditions when the engine is operating. The higher pressure in the exhaust system will thus hold the relief valve 28 closed and there will be no connection between the exhaust manifold 16 and the inlet manifold 16. Should the engine 11 rotate in a reverse direction, however, or should some other condition occur which would cause a low pressure in the exhaust system, the low pressure in the exhaust system would be communicated to the relief valve 28 causing it to open. With the relief valve 28 open, air from the intake manifold would be communicated to the exhaust system to relieve the low pressure. Thus, water would not be drawn up the exhaust system into the engine 11.

The invention thus provides a relief system which protects the engine from the inadvertent admittance of water into the engine through the exhaust system. Further, with the relief valve installed in the engine in accordance with the invention the requirement of a valve in the exhaust system to prevent the entrance of water into the exhaust system can be eliminated.

I claim:

1. In a four cycle engine having an intake manifold for supplying air to the engine and an exhaust system for discharging engine exhaust underwater, the improvement comprising:

a vacuum relief means connected to said exhaust system to relieve any vacuum created in said exhaust system, thereby preventing water from entering said engine through said exhaust system, and vacuum relief means including a passageway connecting said intake manifold with said exhaust system and a one-way valve mounted in said passageway allowing flow into said exhaust system.

2. The device defined in claim 1 wherein said passageway is connected to said exhaust system above the water surface.

3. The device defined in claim 2 wherein the passageway is connected to said exhaust system at approximately the highest point of said exhaust system.

4. The device defined in claim 3 wherein said exhaust system includes an exhaust manifold, an exhaust elbow from said manifold, and an exhaust discharge passage from said exhaust elbow, and wherein said passageway is connected to said exhaust elbow.

5. The device defined in claim 4 wherein said exhaust elbow includes a water jacket and said passageway passes through said water jacket.

* * * * *